US008770211B1

(12) United States Patent
Murray

(10) Patent No.: US 8,770,211 B1
(45) Date of Patent: Jul. 8, 2014

(54) WALKING CANE WITH RETENTION AND TRACTION FEATURES

(76) Inventor: William M. Murray, Enola, PA (US)

( * ) Notice: Subject to any disclaimer, the term of this patent is extended or adjusted under 35 U.S.C. 154(b) by 292 days.

(21) Appl. No.: 13/313,728

(22) Filed: Dec. 7, 2011

(51) Int. Cl.
*A45B 3/00* (2006.01)

(52) U.S. Cl.
USPC ..... 135/66

(58) Field of Classification Search
USPC ..... 135/65, 66, 76, 911; 224/219, 222, 269
See application file for complete search history.

(56) References Cited

U.S. PATENT DOCUMENTS

| | | | | | |
|---|---|---|---|---|---|
| 1,329,915 | A | * | 2/1920 | McKenzie | 135/65 |
| 1,498,287 | A | * | 6/1924 | Ebenezer | 135/65 |
| 2,212,212 | A | * | 8/1940 | Planitz | 224/222 |
| 2,684,682 | A | * | 7/1954 | Hudes et al. | 135/65 |
| 4,229,015 | A | * | 10/1980 | Ramsey et al. | 280/819 |
| 4,300,742 | A | * | 11/1981 | Hunn | 248/689 |
| 4,605,190 | A | * | 8/1986 | Kamp | 248/316.7 |
| 4,794,743 | A | * | 1/1989 | Lehneis | 135/65 |
| 4,796,648 | A | | 1/1989 | Goulter | |
| 4,895,330 | A | * | 1/1990 | Anstead | 248/229.12 |
| 4,971,088 | A | * | 11/1990 | Lyng | 135/65 |
| 5,758,808 | A | | 6/1998 | Epps et al. | |
| 2006/0226315 | A1 | * | 10/2006 | Beasley et al. | 248/229.13 |
| 2008/0053501 | A1 | * | 3/2008 | Wilson et al. | 135/65 |
| 2009/0145470 | A1 | * | 6/2009 | Couper | 135/66 |
| 2009/0229642 | A1 | | 9/2009 | Hutt | |

FOREIGN PATENT DOCUMENTS

| | | | |
|---|---|---|---|
| DE | 29619103 | U1 | 1/1989 |
| JP | 2006334349 | A | 12/2006 |
| JP | 2008279229 | A | 11/2008 |
| JP | 2010042117 | A | 2/2010 |

* cited by examiner

*Primary Examiner* — David R Dunn
*Assistant Examiner* — Danielle Jackson
(74) *Attorney, Agent, or Firm* — Hooker & Habib, P.C.

(57) ABSTRACT

A walking cane includes a length of flexible material forming at least a portion of a closed loop, the loop freestanding above the grip portion of the cane handle when unstressed. The loop has a perimeter defining an opening capable of receiving the hand of a user inserted through the loop to grasp the grip portion of the handle. The end portions of the loop extend below the cane handle and enable the handle to be securely positioned on a surface when the cane is temporarily not in use.

20 Claims, 3 Drawing Sheets

WALKING CANE WITH RETENTION AND TRACTION FEATURES

FIELD OF THE DISCLOSURE

The disclosure relates to a device that enables retention of a walking cane by a user in the event the user loses his or her grip of the cane and positioning of the cane against a surface when the cane is not in use, and related methods.

BACKGROUND OF THE DISCLOSURE

A walking cane is an assistive device that provides mobility for the user. The cane includes a handle and an elongate shaft extending from the handle.

A significant problem faced by cane users is that of the user losing his or her grip of the cane handle and the cane then falling to the ground. For many users, a fallen cane can be very difficult to retrieve.

Wrist straps have been used to enable a user to retain possession of a cane if there is a loss of grip. The strap is typically attached to the handle and hangs below the handle when not in use. Many users, however, find such wrist straps difficult and inconvenient to use. Because the strap extends below the handle, a user is required to insert his or her hand entirely through the strap before the user can start reaching for the handle. This may also require use of the opposite hand to assist with the wrist strap.

Another problem faced by many cane users is placing a cane in a position for easy retrieval while the cane is not being used—for example, while sitting or while changing clothing—while at the same time preventing the cane from falling to the ground. Many users hook the curved handle of a "J" or "crook" handled cane on an object and "hang" the cane on the object while the cane is not being used. However, other conventional cane handles, such as "Fritz" handles or "pistol" handles are relatively flat and cannot be readily hooked like "J" handles.

Although flat-handled canes are often provided with a loop or cord for hanging, such loops or cords require the user to remove his or her grip from the handle before hanging the cane—thereby increasing the risk that the cane will fall to the ground before it can be securely positioned. It is also known to provide the bottom of a flat-handled cane with adhesive to prevent the cane handle from slipping off a support surface, but adhesive soils easily and may leave residue behind.

Thus there is a need for an improved device that enables a user to more easily retain possession of a cane and to enable secure positioning of the cane while the cane is not in use.

BRIEF SUMMARY OF THE DISCLOSURE

Disclosed is a device that better enables a user to retain possession of a cane and better enables secure positioning of the cane while not in use.

A walking cane includes a handle and an elongate shaft extending downwardly from the handle. The handle includes an end portion spaced from the shaft, the end portion including a grip portion configured to be gripped by a user of the cane.

A walking cane may include a retention device fixedly attached solely to the end portion of the handle. The retention device includes a length of flexible material forming at least a portion of a closed loop, the loop freestanding above the grip portion when unstressed. The loop has a perimeter defining an opening capable of receiving the hand of a user inserted through the loop to grasp the grip portion of the handle.

When a user reaches to grasp the handle grip portion, the user's hand passes through the loop. The loop enables the user to retain possession of the cane even if the grip of the handle grip portion is lost.

In a preferred embodiment, the flexible material includes a pair of end portions that extend below the handle. The end portions form part of a traction device that resists slipping of the cane when the handle portion is placed against a support surface such as the top of a table or chair.

In yet other embodiments the traction device can be located on an end of the handle opposite the shaft from the grip portion of the handle.

In yet further embodiments only the retention device or only the traction device is attached to the cane.

The disclosed retention and traction device enables a user to securely retain possession of a cane by reaching for the handle in a conventional manner, without requiring a separate, additional motion to place one's hand through a strap. The traction device enables even flat-handled canes to be securely positioned on surfaces when temporarily not in use, without the use of adhesives and without the need to hook the cane.

The retention and traction device can also be easily and inexpensively retrofitted to existing canes.

Other objects and features will become apparent as the description proceeds, especially when taken in conjunction with the accompanying drawing sheets illustrating multiple embodiments.

DESCRIPTION OF THE PREFERRED EMBODIMENT

Figure 2:
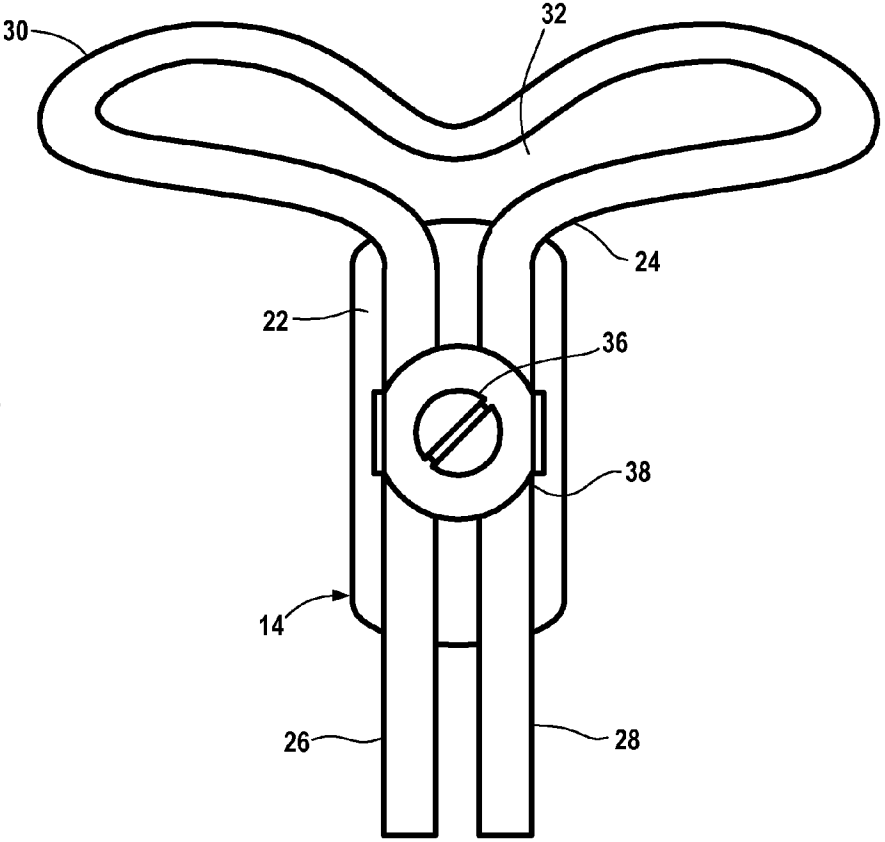
FIG. 2 is a view taken along line 2-2 of FIG. 1.
Figure 1:
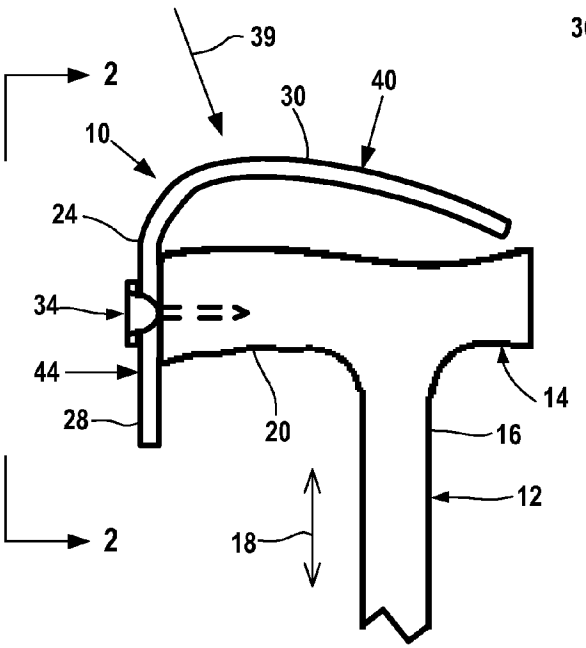
FIG. 1 is an elevation view illustrating a combination retention and traction device attached to a "Fritz"-type handle of a walking cane.

FIGS. 1 and 2 illustrate a retention and traction device 10. The device 10 is attached to an otherwise conventional cane 12 having a Fritz-type handle 14 and an elongate shaft 16 extending from the handle 14. The shaft 16 extends along a shaft axis 18, with the handle 14 located axially above the shaft 16. For clarity, the shaft 16 is omitted from FIG. 2.

The handle 14 includes a handle end portion 20 spaced from the shaft 16 and configured to be gripped by the user. The end portion 20 extends to a free end defined by an end surface 22. The illustrated end surface 22 is oriented parallel with the shaft axis 18.

The retention and traction device 10 is fixedly attached to the handle end surface 22. The device 10 includes a length of elastomeric, flexible material 24. The illustrated material 24 is one-quarter-inch diameter plastic tubing. The flexible material 24 has a pair of opposite end portions 26, 28. The end portions 26, 28 are placed adjacent one another and slightly spaced apart against the surface 22 to define a freestanding loop 30 of the flexible material 24, the loop 30 extending axially above and over the handle 14 and defining an opening 32. The loop opening 32 is preferably substantially wider than the width of the handle 14; as seen in FIG. 2, the illustrated opening 32 is about four times the width of the handle 14. The end portions 26, 28 extend below the handle 14. A fastener 34 that includes a screw 36 and a "U"-shaped retainer 38 compresses and holds the end portions 26, 28 fixed beneath the retainer 38 and against the handle end surface 22. The retainer 38 can, in one possible embodiment, be formed by bending opposite side portions of a circular metal washer to wrap around the lateral borders of the tubing portions 26, 28.

A user normally grips the handle of the cane 12 by moving the hand towards the cane handle portion 20 from above the handle 14, this movement of the user's hand represented by the arrow 39 (see FIG. 1).

With the device 10 installed as shown in FIGS. 1 and 2, the loop 30 is located over and above the handle portion 20. The loop 30 does not require the user to materially alter or change the normal hand movement 39 in reaching for and gripping the cane handle portion 14 when using the device 10. The hand moving in the direction 39 passes through the loop opening 32 in reaching for the handle portion 20. The relatively wide width of the loop opening 32 facilitates entry of the hand through the loop 30 without interference from the loop itself. The loop 30 thereby encircles the user's wrist after the user grips the cane handle portion 20 in essentially a conventional manner (that is, as if there were no device 10 present). The material 24 has sufficient rigidity such that the loop 30 is spaced away from the handle 14 to allow the user's hand to readily slip beneath the loop 30 when taking grasp of the handle portion 20.

The loop 30 is sized to comfortably receive the hand of the user through the loop opening 32. The loop perimeter is preferably between about twelve inches and twenty inches. The applicant has found that a loop perimeter of about fifteen inches satisfactorily receives essentially all hand sizes comfortably.

If the user loses his or her grip on the handle portion 20, the loop 30 surrounding the user's wrist retains the user's possession of the cane 12, preventing the cane 12 from falling to the ground. Furthermore, the user can voluntarily release his or her grip on the handle portion 20 for performing some other task and the loop 30 retains user possession of the cane 12. Thus the loop 30 and the fastener 34 cooperatively define a retention device 40 that forms part of the retention and traction device 10.

Figure 3:
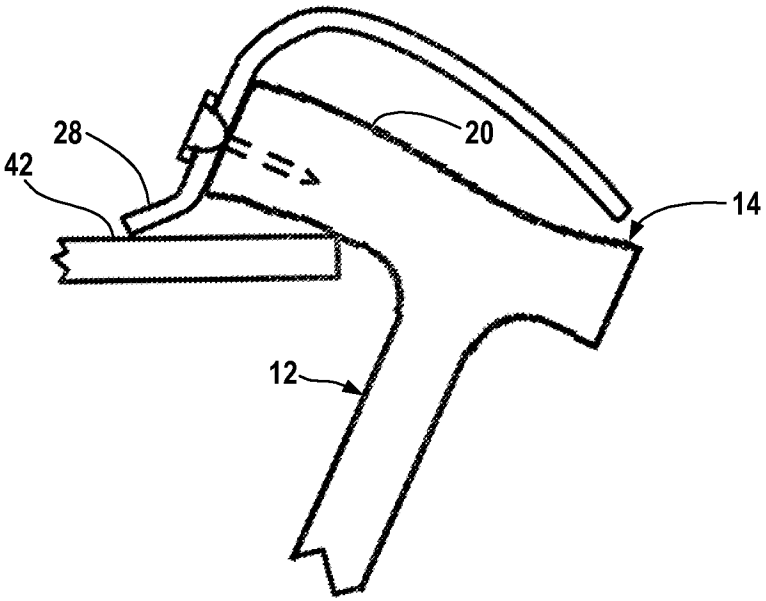
FIG. 3 illustrates operation of the device shown in FIG. 1 in securely positioning the cane handle against a surface.

FIG. 3 illustrates the cane 12 after a user has positioned the cane 12 against a flat, horizontal surface 42 (which surface 42 could be the surface of a countertop, table, or the like), with the handle portion 20 placed over the surface 42.

The material end portions 26, 28 projecting from the end of the handle 14 extend sufficiently beyond the handle 14 to engage the surface 42 and space the cane end 22 from the surface 42. Generally, for most canes, the end portions 26, 28 extend from between about one inch to about two inches beyond the bottom of the cane 12 to assure proper engagement against the surface 42.

The user can grip the sides of the handle 14 while placing the handle 14 against the surface 42.

The weight of the cane 12 generates a moment attempting to compress the end portions 26, 28. The end portions 26, 28 elastically deform and generate a normal force against the surface 42. The elastomeric material forming the end portions 26, 28 has sufficient non-slip characteristics that a friction force generated between the end portions 26, 28 and the surface is capable of preventing the cane 12 from sliding off the surface 42.

Thus the end portions 26, 28 and the fastener 34 cooperatively define a traction device 44 (see FIG. 1) that enables stable support of the cane 12 against a support surface 42 by resisting slipping of the cane handle portion 20 off of a support surface 42. The applicant has found the traction device 44 can stabilize the cane 12 even when the device 44 is placed against sloping surfaces (such as the top of an upholstered chair or the like).

Figure 4:
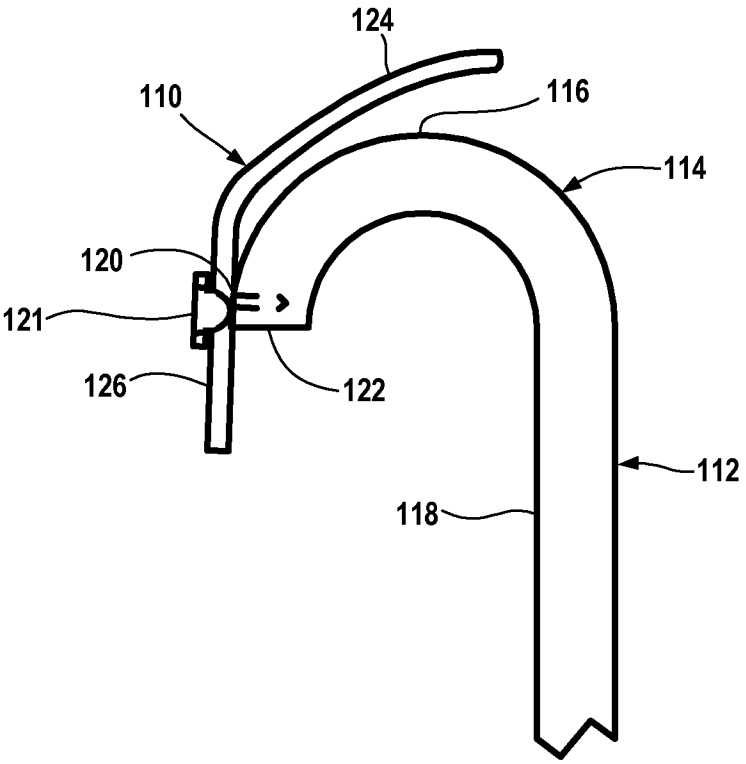
FIG. 4 is similar to FIG. 1 but illustrates the device attached to a "J"-type handle of a walking cane.

FIG. 4 illustrates a retention and traction device 110 similar to the retention and traction device 10 attached to a "J"-handled walking cane 112. The cane 112 is similar to the cane 12 but includes a curved handle 114 having a handle grip portion 116 spaced from the cane shaft 118 and configured to be gripped by the user. In this embodiment the retention and traction device 110 is attached to a handle surface 120 by a "C"-shaped retainer 121 curved to conform to the outer radius of the cane handle 114. The retainer 121 is attached to the handle 114 between the handle grip portion 116 and the handle end 122. The loop 124 of the device 110 extends upwardly above and over the handle grip portion 116 to receive the hand of a user gripping the handle portion of the cane 112 as previously described. The end portions 126 of the device 110 extend below the handle 114 to form part of a traction device as previously described.

In alternative embodiments the material 24 may be a different material, and may be a non-tubular material. The material forming the loop 30 may be different than the material forming the projecting members 26, 28.

In yet other embodiments, the retention device 40 or the traction device 44 may be eliminated. For example, the traction device 44 could be eliminated when attached to a J-handled cane if hooking the cane is intended as the sole means for positioning. In yet further embodiments, the retention device 40 and the traction device 44 can be attached to different surfaces of the cane. For example, if the end of a non-grip portion of the cane handle is farther from the cane shaft than the end of the grip portion, the traction device 44 can be attached to the end of the non-grip portion since the longer non-grip portion would be placed against the supporting surface.

It is intended that the retention and traction device 10, 110 (or the separate retention device 40 and traction device 44 in those embodiments in which the devices 40, 44 are separate devices) be fixedly attached to the cane 12 while the device 10, 110 is in use, that is, it is not desirable that the device 10, 110 be able to slide along the handle of the cane (such as a loop of fabric can slide along a handle). The illustrated embodiments illustrate walking canes 12 in which the retention and traction devices 10, 110 remain permanently attached to the cane. In other embodiments, portions of the retention and traction devices 10, 110 can be removably or detachably attached to a portion of the fastener 34 that remains permanently and fixedly attached to the cane 12. For example, the permanently attached portion can be a piece of hook-and-loop fastener glued to the outer surface of the cane handle 14. A cooperating piece of hook and loop fastener could carry the loop portion 30 and the projecting portions 26, 28.

In yet other embodiments the fastening structure of the retention and traction devices 10, 110 can include a "cup" having a tubular sleeve that fits over the end portion of the cane handle with an interference fit to fixedly attach the devices 10, 100 to the cane while the devices are in use. The cup or sleeve is preferably formed of rubber or other high-friction elastic material that prevents slipping of the fastener structure during use of the cane.

While one or more embodiments have been illustrated and described herein, it is understood that these are capable of modification, and therefore the scope of the disclosure is not limited to the precise details set forth but also includes such changes and alterations as fall within the purview of the following claims.

What I claim as my invention is:

1. A walking cane comprising:

a handle and an elongate shaft extending downwardly from the handle along a first axis, the handle comprising an end portion spaced from the shaft, the end portion including a grip portion, the grip portion having a first end and a second end separated by a length of the grip portion, the second end spaced away from the first end in a direction along a second axis perpendicular to the first axis, the grip portion being configured for gripping by a user of the cane;

a retention device fixedly attached solely to the end portion of the handle, the retention device comprising a length of flexible material forming at least a portion of a closed loop, the loop freestanding above the grip portion when unstressed, the loop having a perimeter defining an opening capable of receiving the hand of a user inserted through the loop to grasp the handle, the loop overlaying the grip portion of the handle and extending from the first end of the grip portion to at least the second end of the grip portion whereby the opening overlays the length of the grip portion.

2. The walking cane of claim 1 wherein said end portion comprises a surface located at a free end of the end portion, the retention device fixedly attached to the surface.

3. The walking cane of claim 1 wherein said handle end portion comprises a free end, and the retention device is fixedly attached to a surface spaced from the free end.

4. The walking cane of claim 1 wherein the flexible material is tubing.

5. The walking cane of claim 1 wherein the retention device comprises a fastener compressing the flexible material against the handle end portion.

6. The walking cane of claim 1 wherein the loop has a perimeter of between about twelve inches and twenty inches.

7. The walking cane of claim 1 wherein the length of flexible material comprises a pair of end portions, the end portions extending below the handle.

8. The walking cane of claim 7 wherein the end portions of the material extend at least one inch below the handle when unstressed.

9. The walking cane of claim 1 wherein the grip portion extends along a straight line parallel to the second axis from the first end of the grip portion to the second end of the grip portion.

10. The walking cane of claim 1 wherein the grip portion extends along a curved line from the first end of the grip portion to the second end of the grip portion.

11. A method of assembling a retention device on a walking cane having a handle and a shaft extending downwardly from the handle along a first axis, the handle having an end portion spaced from the shaft, the end portion including a grip portion configured to be gripped by a user, the grip portion having a first end and a second end, the second end spaced away from the first end in a second direction by the length of the grip portion along a second axis perpendicular to the first axis, the method comprising the steps of:

(a) providing a loop formed at least partially from a length of flexible material;

(b) placing the loop against a surface of the handle end portion with a portion of the loop extending above the handle and over the grip portion, the loop defining an opening to receive the hand of a user intending to grasp the grip portion, the loop opening overlaying the length of the grip portion; and (c) fixedly attaching the placed loop to said surface.

12. The method of claim 11 wherein the length of flexible material comprises opposite end portions, and step (b) comprises the step of placing the end portions adjacent one another against said surface with the remaining length of flexible material extending above the handle;

and step (c) comprises the step of fixedly fastening the adjacent end portions against said surface.

13. The method of claim 12 wherein the end portions each extend below the handle.

14. The method of claim 11 wherein the loop has a perimeter of not less than about twelve inches and not more than about twenty inches.

15. The method of claim 11 wherein said surface is located on an end of said end portion.

16. The method of claim 11 wherein said surface is located away from an end of said end portion.

17. A walking cane comprising:

a handle and an elongate shaft extending downwardly from the handle along an axis, the handle comprising an end portion spaced from the shaft, the end portion including a grip portion for gripping by a user of the cane;

a retention device fixedly attached solely to the end portion of the handle, the retention device comprising a length of flexible material forming at least a portion of a closed loop, the loop freestanding above the grip portion when unstressed, the loop having a perimeter defining an opening capable of receiving the hand of a user inserted through the loop to grasp the handle, and the length of flexible material comprises a pair of end portions, the end portions extending below the handle.

18. The walking cane of claim 17 wherein the end portions of the flexible material extend at least one inch below the handle when unstressed.

19. A method of assembling a retention device on a walking cane having a handle and a shaft extending axially downwardly from the handle, the handle having an end portion spaced from the shaft, the end portion including a grip portion configured to be gripped by a user, the method comprising the steps of:

(a) providing a length of flexible material, the length of flexible material comprising opposite end portions;

(b) placing the end portions adjacent one another against said surface with the end portions each extending below the handle and the remaining length of flexible material extending above the handle to form a loop defining an opening to receive the hand of a user intending to grasp the grip portion; and (c) fixedly attaching the placed loop to said surface with the adjacent end portions fastened against said surface.

20. A method of assembling a retention device on a walking cane having a handle and a shaft extending axially downwardly from the handle, the handle having an end portion spaced from the shaft, the end portion including a grip portion configured to be gripped by a user, the method comprising the steps of:

(a) providing a loop formed at least partially from a length of flexible material;

(b) placing the loop against a surface of the handle end portion located away from an end of said end portion, with a portion of the loop extending above the handle and over the grip portion, the loop defining an opening to receive the hand of a user intending to grasp the grip portion; and (c) fixedly attaching the placed loop to said surface.

* * * * *